US006959843B2

(12) United States Patent
Kondo

(10) Patent No.: US 6,959,843 B2
(45) Date of Patent: Nov. 1, 2005

(54) POWDERY MOLD COATING AGENT SUPPLY DEVICE

(75) Inventor: Jun Kondo, Nishio (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 552 days.

(21) Appl. No.: 10/025,483

(22) Filed: Dec. 26, 2001

(65) Prior Publication Data

US 2002/0079330 A1 Jun. 27, 2002

(30) Foreign Application Priority Data

Dec. 26, 2000 (JP) ..... 2000-396056

(51) Int. Cl.[7] ..... B65D 83/00

(52) U.S. Cl. ..... 222/195; 222/203; 222/399; 222/450

(58) Field of Search ..... 222/195, 199, 222/202, 203, 399, 448, 450, 451, 453

(56) References Cited

U.S. PATENT DOCUMENTS 1,891,038 A * 12/1932 Barros ..... 222/438
2,726,019 A * 12/1955 Moran ..... 222/445
4,109,835 A * 8/1978 Castro ..... 222/449
4,792,235 A * 12/1988 Paul ..... 366/107
5,437,335 A * 8/1995 Hines, Sr. ..... 172/22
5,758,803 A * 6/1998 Liao et al. ..... 222/440
5,921,369 A * 7/1999 Steele ..... 193/25 R

* cited by examiner

*Primary Examiner*—Joseph A. Kaufman
(74) *Attorney, Agent, or Firm*—Oblon, Spivak, McClelland, Maier & Neustadt, P.C.

(57) ABSTRACT

A powdery mold coating agent supply device includes a tank having at its lower portion a discharge port, the tank storing therein an amount of powdery mold coating agent, a supply, tube connected at its upper end portion to the discharge port and extending downwardly along a vertical line, a first open/close device provided in an upper side of the supply tube for the opening/closing thereof, and a second open/close device provided in a lower side of the supply tube for opening/closing the supply tube and placed away from the first open/close device by a predetermined distance.

7 Claims, 9 Drawing Sheets

POWDERY MOLD COATING AGENT SUPPLY DEVICE

The present application is based on and claims priority under 35 U.S.C § 119 with respect to Japanese Patent Application No. 2000-396056 filed on Dec. 26, 2000, the disclosure of which is incorporated herein by reference.

BACKGROUND OF THE INVENTION

1. Field of the Invention

The present invention is generally directed to a powdery mold coating agent supply device.

2. Discussion of the Background

In die casting, mold lubricants play a very important part in prolonging the life of mold and/or improvement in production productivity due to the fact that the mold lubricants prevent an adhesion of molten metal onto an inside surface of the mold, prevent burn-in of the inside surface of the mold, and improve establishment of an easy separation of a die-cast product from the mold. Of the mold lubricants, a water-soluble mold lubricant is widely employed. However, with respect to such an employment of the water-soluble mold lubricant, the following problems or disadvantages have been noted. The mold lubricant remains in the mold and the resultant gas is introduced into the die-cat product, resulting in making the product poor. The mold lubricant is applied on the inner surface of the mold with the mold opened, which causes the mold lubricant to fly in all directions, thereby determining the working environment.

In view of such problems, a recent technology has developed a new powdery mold lubricant whose solvent is free from water and which is capable of being applied onto an inside surface of a mold. For the application of such a powdery mold lubricant, a powdery mold lubricant apply device is provided which is disclosed in Japanese Patent Laid-open Print No. Hei. 11(1999)-128814.

In detail, referring to FIG. 9(*a*) and FIG. 9(*b*), there is illustrated the aforementioned powdery mold lubricant application device. The device includes a tank 102 in which an amount of the above-mentioned powdery mold lubricant is stored. The tank 102 is provided at its lower end portion with an outlet 101 with an orifice 104. The outlet 101 of the tank 102 is in fluid communication with an air reverse-flow channel 105 which is defined by a pinch valve 107 and an ejector 110.

A lower wall 103, which constitutes or defines a lower portion of the tank 102, is configured to be elastic. At an outside portion of the lower wall 103, there is provided an air supply port 111 for vibrating the lower wall 103 in a pulsatory fashion. The air supply port 111 is in fluid communication with a pressurized-air source 112 and air under pressure is supplied from the pressurized-air source 112 to the air supply a port 111 in an intermittent fashion or in an on-off fashion such that the number of on-off frequency and/or on-time (off time) duration are arbitrary.

The air reverse-flow channel 105 is provided with an air inlet 113 for air supply to the tank 102 in an upside down fashion. The air inlet 113 is in fluid communication with the pressurized-air source 112. The pinch valve 107 is provided with a pinch rubber 106 and an air supply port 109. The air-supply port 109 is in fluid communication with the pressurized-air source 112 in order that the on and off of air supply from the pressurized-air source 112 causes the pinch valve 107 to open and close, alternately.

The ejector 110 is provided with a discharging hose 115 from which the powdery mold lubricant is discharged to the inside surface of the mold. The ejector 110 is provided with air supply ports 114 and 108 for powdery mold lubricant discharge and air blow, respectively.

In operation, first of all, the pressurized air is applied to the powdery mold lubricant in the tank 102 by way of the air reverse-flow channel 105 for temporally floating the powdery mold lubricant in the tank 102. Next, after such application of the pressurized air from the air reverse-flow channel 105 is terminated, the pressurized air is applied from the air pressure source 112 to the air supply port 111 in on-and-off fashion to bring the lower wall 103 in pulse mode vibration at a fixed interval. At this time, the pressurized air is applied from the air supply port 108 for controlling a supply amount of powdery mold, lubricant in cooperation with the pulse mode vibration of the lower wall 103.

When the pinch valve 107 is closed after termination of the air supply to the air supply port 111, the pressurized air is supplied by way of the air supply port 114 to the ejector 110 for supplying the powdery mold coating agent which is in the form of a mixture with the air to the mold whose cavity is an evacuated state. The sequence of such operations is repeated to apply the powdery mold coating agent onto the inner surface of the mold. However, in the aforementioned or conventional device, while the cooperation of the air supply to the air supply port 108 and the pulse mode vibration of the lower wall 103 measure or determine the amount of the powdery mold coating agent, when an air leakage occurs at the air supply port 108, such air is brought into mixture with the powdery mold coating agent, and the resultant combination or air-mixed powdery mold coating agent is fed into the cavity of the mold. Thus, the advantage or merits in previously evacuation of the cavity of the mold is diluted or lowered, which reduces the adhesive or bonding ability of the powdery mold coating agent onto inner surface at details in the cavity, resulting in that the powdery mold coating agent becomes difficult to adhere to or be apply evenly onto the inner surface in the cavity. Consequently, the releasing function or effect of the powdery mold lubricant fails to be fully realized, which results in a quality problem in die-cast productions.

Thus, a need exists to provide a powdery mold coating agent supply device which is free from the foregoing problems or drawbacks, which is capable of establishing an even application of a powdery molding coating agent onto an inner surface of a mold, and which can permit the mold to die cast a high-quality production.

SUMMARY OF THE INVENTION

In accordance with the first aspect of the present invention, a powdery mold coating agent supply device includes:

a tank storing therein a powdery mold coating agent, the tank being provided at a lower portion thereof with a discharge port;

a supply tube connected at its upper end to the discharge port, the supply tube extending along a vertical line;

first open/close valve means provided at an upper position of the supply tube for opening and closing the supply tube; and second open/close valve means provided at a position of the supply tube so as to be lower than the position of the first open/close valve means by a predetermined distance, the second open/close valve means being for opening and closing the supply tube.

Thus, the first open/close valve means and the second open/close valve means make it possible to bring each of the tank, the supply tube, and a mold into a closed space state and therefore an inside portion of the mold can, be kept in a vacuum state by closing the open/close valve means until ready for an injection of the powdery mold coating agent. In addition, the powdery mold coating agent is dropped into the supply tube to fill the same and thereafter is pushed out by, for example, gas, which establishes a priority feeding of the powdery mold coating agent into the mold which kept at stable vacuum state, resulting in uniform adhesion or application of the powdery mold coating agent onto the inside surface of the mold. Such uniform adhesion or application of the powdery makes it possible to produce die cast products of high quality.

In accordance with the second aspect of the present invention, a powdery mold coating agent supply device of the first aspect further includes powdery mold coating agent measuring means for measuring a supply amount of the powdery mold coating agent, the powdery mold coating agent measuring means being interposed between the tank and the supply tube.

Thus, providing the powdery mold coating agent measuring means makes the supply amount of the powdery mold coating agent very precise.

In accordance with a third aspect of the present invention, a powdery mold coating agent supply device of the second aspect is modified such that the powdery mold coating agent measuring means includes a measuring portion of a fixed volume, the powdery mold coating agent measuring means being configured to be of a slide cutting type such that the measuring portion traverses a space, in sliding reciprocation mode, which is defined between a right-below of the discharge port of the tank and a right-above of the supply tube.

Thus, configuring the powdery mold coating agent measuring means into the slide cutting type makes it possible to establish an easy measuring of the powdery mold coating agent with simple structure at a lower cost.

In accordance with a fifth aspect of the present invention, a powdery mold coating agent supply device of the first aspect is modified such that the first open/close valve means and/or the second open/close valve means are a pinch valve.

Thus, employing a pinch valve as the open/close valve means prevents damage caused by the powdery mold coating agent.

In accordance with a fifth aspect of the present invention, a powdery mold coating agent supply device of any one of the first, second, third, and fourth aspects further includes a pressurized air supply means for air-blow movement of the powdery mold coating agent.

Thus, employing the pressurized air supply means for air-blow movement of the powdery mold coating agent makes it possible to establish easy movement of the powdery mold coating agent at a lower cost.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENT

Hereinafter, a powdery mold lubricant supply device as an embodiment of the present invention which is generally directed to a powdery mold coating agent supply device will be describe in great detail with reference to the attached drawings.

Figure 1:
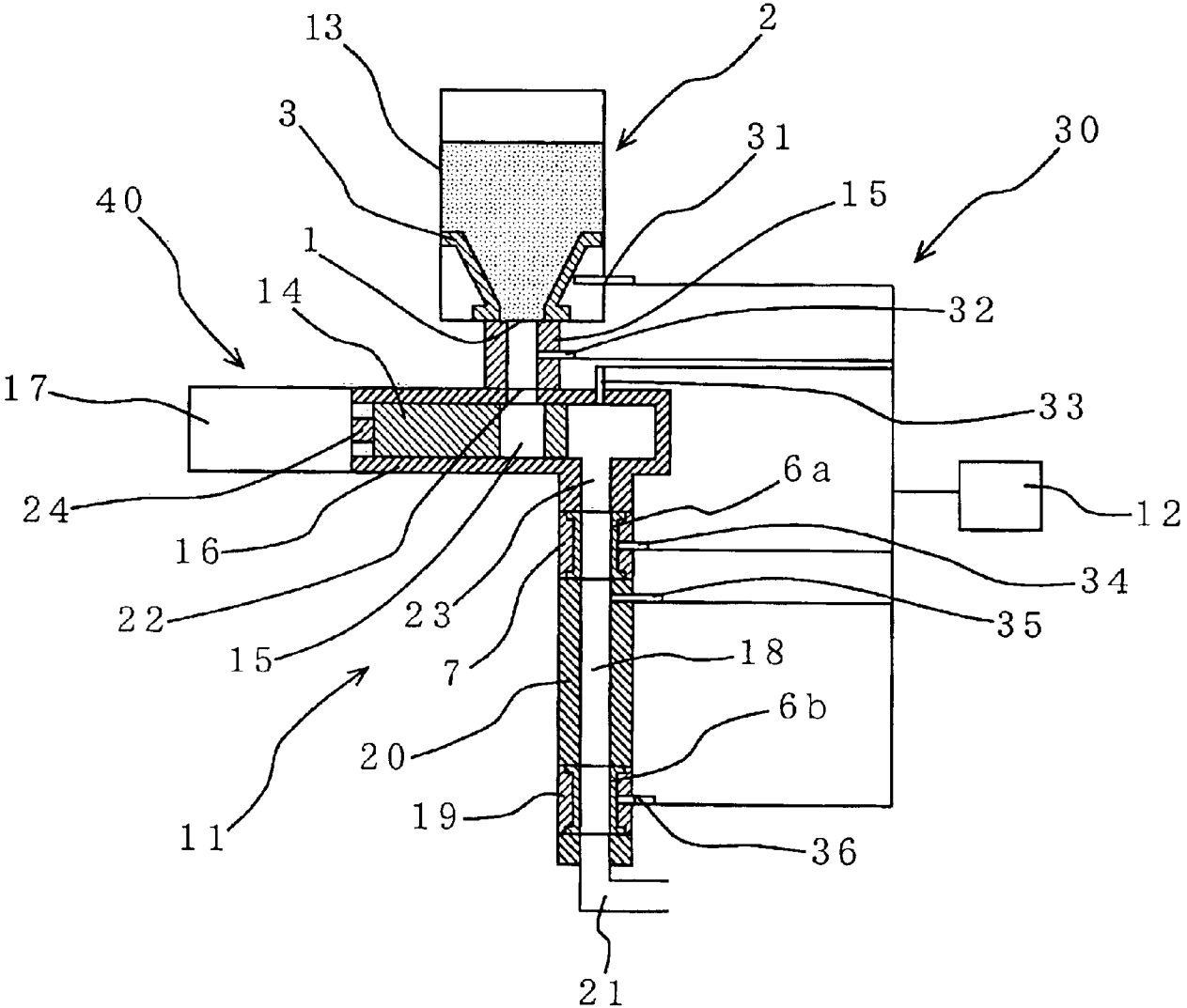
FIG. 1 is a schematic cross-sectional view of a powdery mold coating agent supply device.

In FIG. 1 which illustrates a schematic cross-sectional view of the powdery mold lubricant supply device in accordance with the present invention, the powdery mold lubricant supply device includes a tank 2 in which an amount of powdery mold lubricant is stored, an air reverse-flow circuit 5, a fixed amount measuring mechanism 11, and a pressurized air supply mechanism 30.

The tank 2 is formed of a synthetic resin and has a surrounding wall 13 and an elastic lower wall 3. The fixed amount measuring mechanism 11 is made up of a powdery mold lubricant measuring portion 40 (as powdery mold lubricant measuring portion), a first pinch valve 7 (as first open/close means), a second pinch valve 8 (as second open/close means), a supply tube 20, a supply hose connected to a mold having a cavity shown in FIGS. 6(*a*)–(*c*) and other elements. The pressurized-air supply mechanism 30 is made up of a pressurized-air source 12, an air supply ports 31 to 36 inclusive, and other elements. Fluid communication is established between the pressurized-air source 12 and each of the air supply ports 31 to 36 inclusive by way of a corresponding conduit. Each conduit is provided therein with an open/close valve (not shown) which is to be opened or closed by order of a control device (not shown).

The powdery mold lubricant measuring portion 40 is made up of a cylinder 16, a piston 14, a driving mechanism 17, and other elements. The piston 14 is fitted in the cylinder 16 in sliding fashion and is connected by way of a rod 24 to the driving mechanism 17. The piston 14 is formed therein with a fixed volume space 15 (as a measuring portion) which extends in the radial direction of the piston 14 in penetrating fashion. The cylinder 16 is placed so as to ensure that the piston 14 can slide in the horizontal direction substantially. At an upper portion of the cylinder 16, there is provided an upper port 22. At a lower portion of the cylinder 16 which is positioned at a more right side of the upper port 22, there is formed a lower port 23.

The air reverse-flow circuit 5 is arranged to connect between the upper port 22 and a discharging port 1 which is formed at the lower portion of the tank 2 for discharging the powdery mold lubricant. Supplying an air under pressure into the air reverse-flow circuit 5 has a function of causing the powdery mold lubricant to contain therein the resultant air to thereby floating the resultant powdery mold coating agent temporally. The lower port 23 is connected with the supply tube 20.

The supply tube 20, which is placed below the tank 2, is arranged in the vertical direction or along the plumb line so as to be in fluid communication with the tank 2 by way of the powdery mold lubricant measuring portion 40. Upper and lower portions of the supply tube 20, there are provided the first pinch valve 7 and the second pinch valve 19, respectively. At a lower side of the second pinch valve 19, the supply tube 20 is connected to the hose 21 which terminates in the mold. The first pinch valve 9 is provided therein with a first pinch rubber 6*a*, while the second pinch valve 19 is provided therein with a second pinch rubber 6*b*. In an inside portion in the supply tube 20 which extends between the first pinch rubber 6*a* and the second pinch rubber 6*b*, there is defined a space portion 18 for storing the powdery mold lubricant temporally. At a side portion of the supply tube 20 which is positioned above the space portion 18, there is provided the air supply port 35 for supplying the pressurized air into the space portion 18.

At a side of the lower portion of the tank 2, there is provided the air supply port 31 for receiving the air under pressure which is in the form of pulse from the pressurized air from the pressurized air source 12. The pulsed pressurized air which is produced by turned on and off the alternately the pressurized air source 12 in a repletion mode causes the lower wall 3 of the tank 2 to vibrate, which results in dropping the powdery mold lubricant. The air supply port 35 is provided in the air reverse-flow circuit 5. The air supply port 33 is provided at an upper portion of the cylinder 16 so as to oppose the lower port 23. Establishing and interrupting the air supply to the air supply port 34 (36) causes the pinch rubber 6*a* (6*b*) to open and close, respectively.

Figure 2:
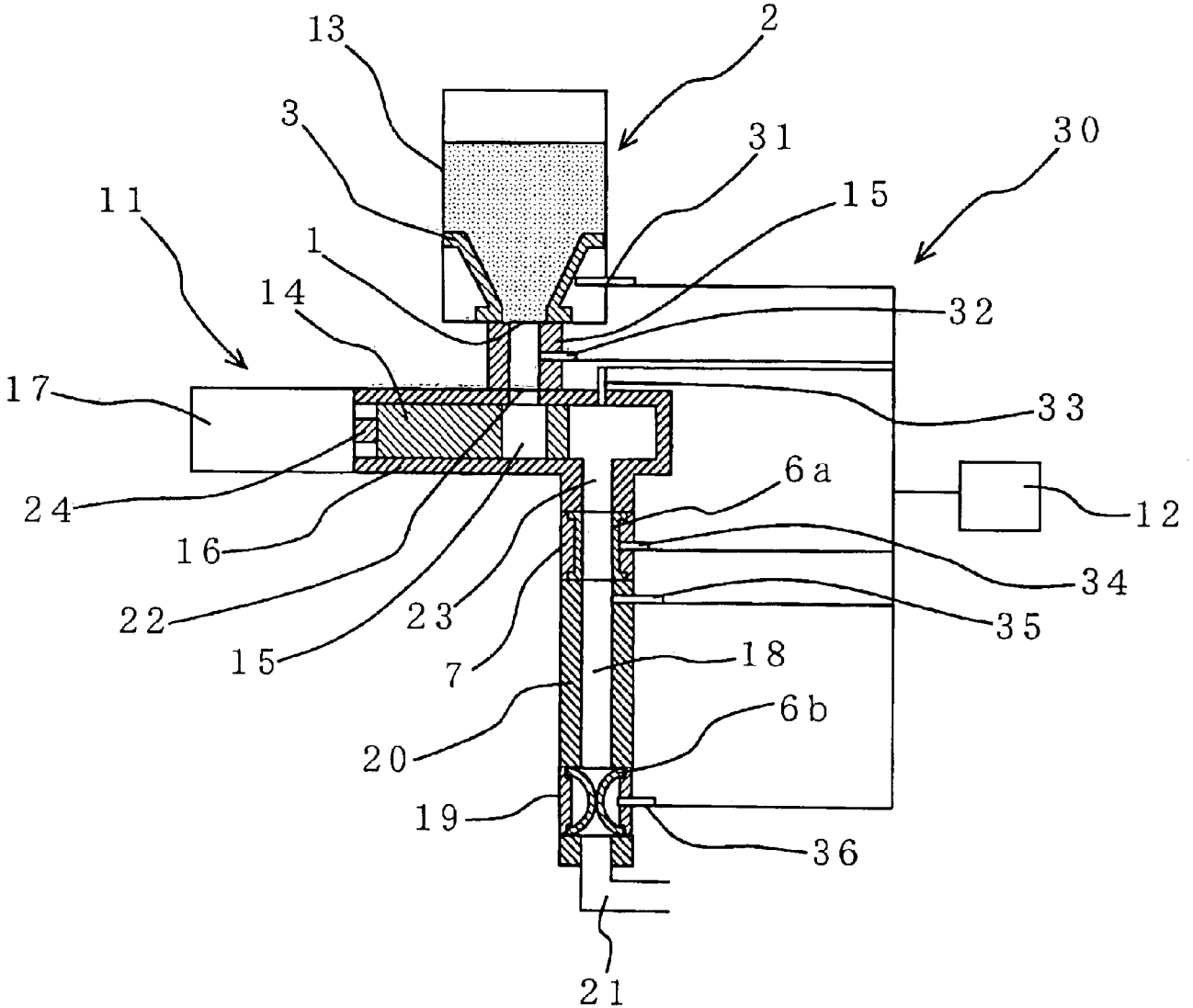
FIG. 2 illustrates a condition of the device shown in FIG. 1 upon initiation of operation thereof.

In operation, first of all, as shown in FIG. 2, the driving mechanism 17 moves the piston 14 to its fully retracted position, the air supply to the air supply port 34 is interrupted to open the first pinch valve 7, and the air supply to the air supply port 36 is established to close the second pinch valve 19. When the piston 14 reaches its fully retracted position, the fixed volume space 15 is brought into an in-line relation with the upper port 22 of the cylinder 16, an inside passage of the air reverse-flow circuit 5, and the discharging port 1 of the tank 2.

Figure 3:
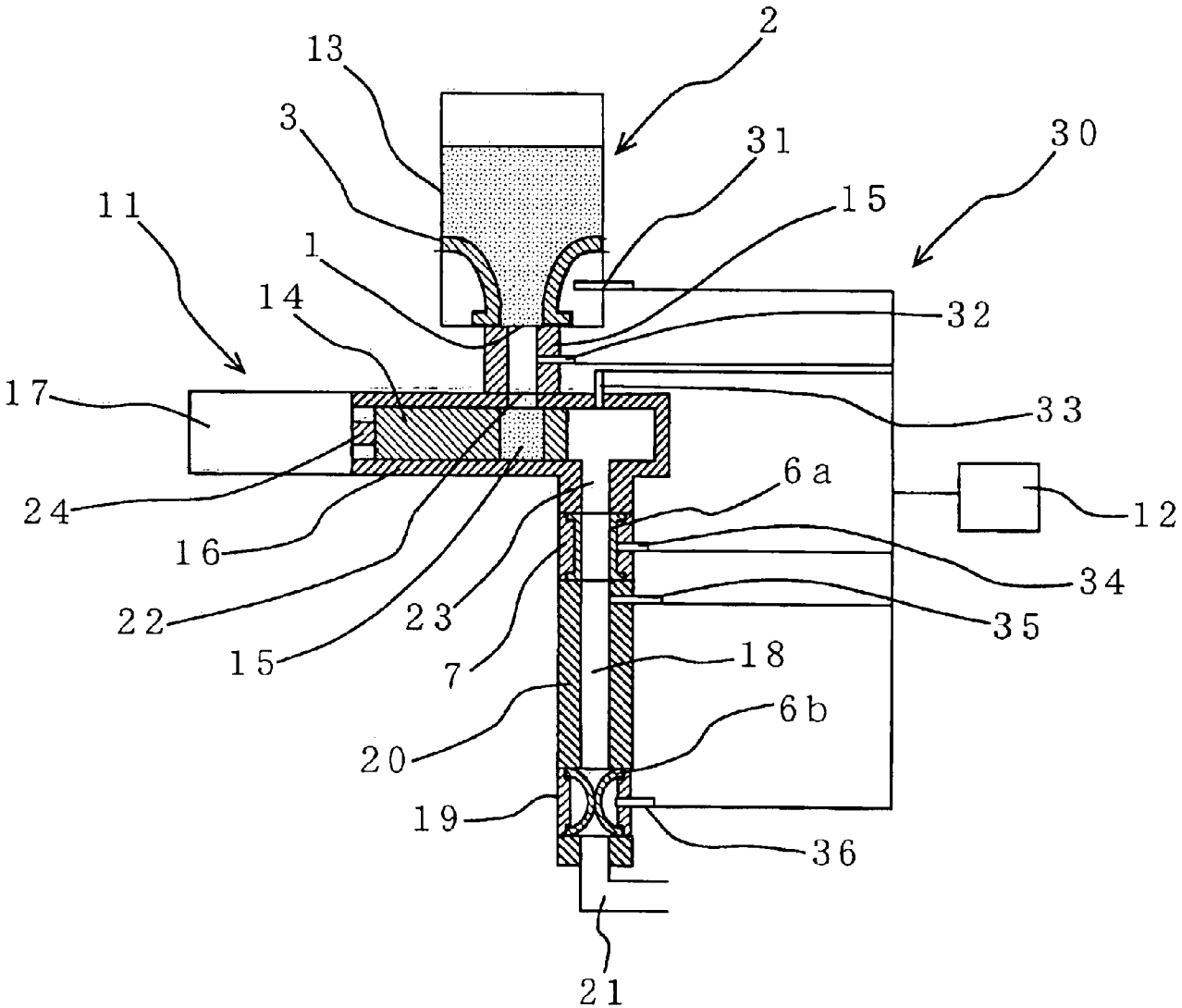
FIG. 3 illustrates how a powdery mold coating agent is fed into a fixed volume space in the device shown in FIG. 1.

Then, as shown in FIG. 3, the air reverse-flow circuit 5 is supplied with the pressurized air by way of the air supply port 32 to float the powdery mold lubricant in the tank 2 temporally. The lower wall 3 of the tank 2 is vibrated via a pulse mode by supplying the pressurized air to the air supply port 31 in on-and-off fashion or intermittently and the powdery mold lubricant is dropped into the fixed volume space 15.

Figure 4:
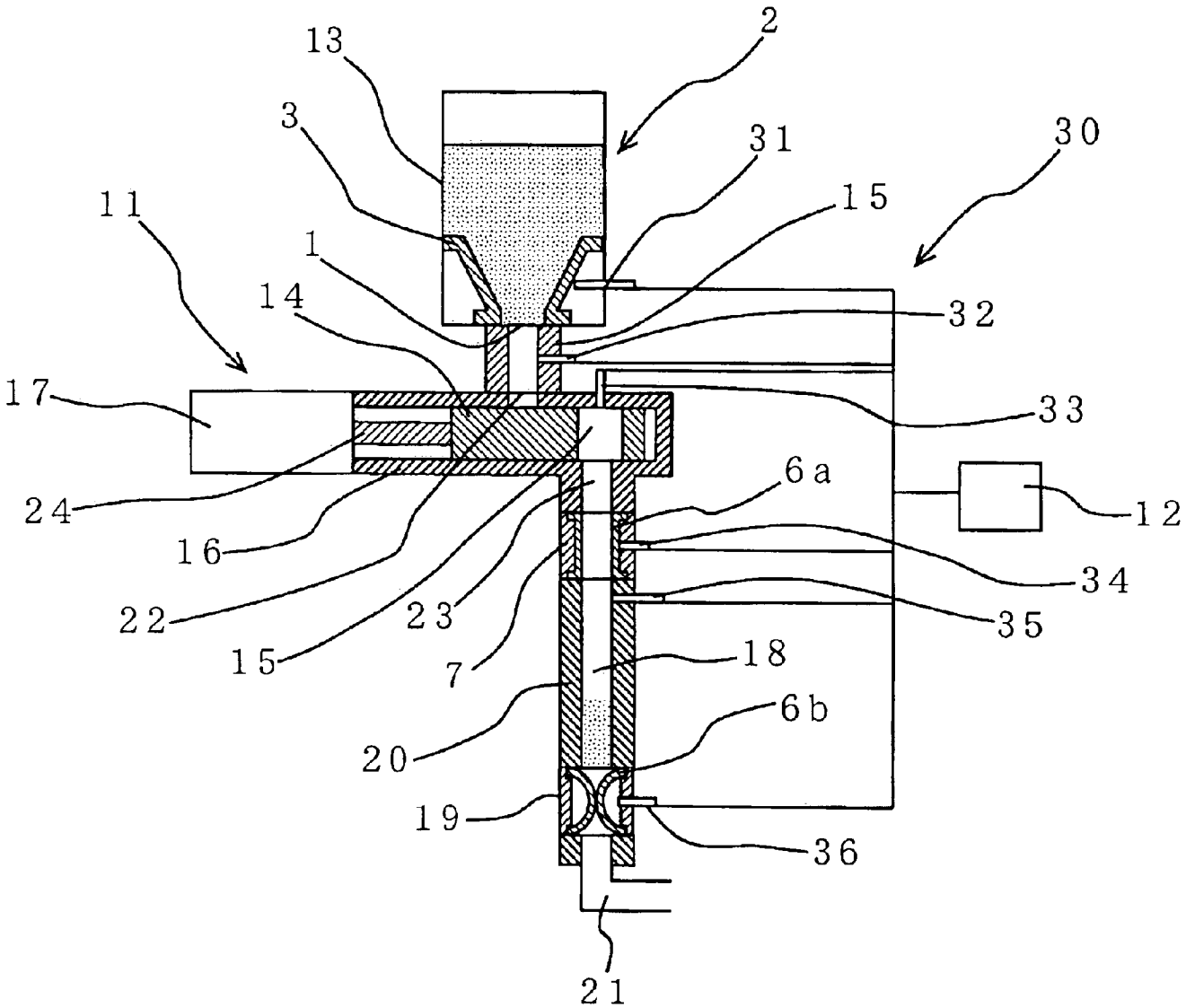
FIG. 4 illustrates how the powdery mold coating agent is fed to a supply pipe in the device shown in FIG. 1.

When the amount of the powdery mold lubricant is found to be sufficient, the driving mechanism 17 advances the piston 14 due to the fact that the piston 14 is in sliding engagement with an inner side of the cylinder 16, the volume of the fixed volume space 15 remains unchanged independently of the current position of the piston 14. The piston 14 is stopped when the piston 14 reaches its fully advanced position. At this time, as shown in FIG. 4, the fixed volume space 15 is brought into an in-line position with the lower port 23 and the supply tube 20. In the resultant state, the powdery mold lubricant is dropped into the supply tube 20. However, due to poor fluidity of the powdery mold lubricant, the drop of the powdery mold lubricant by its own weight is not perfect. For establishing the drop of the powdery mold lubricant perfectly, an air supply is communicated to the air supply port 32. Thereafter, the driving mechanism 17 moves the piston to its most retracted position. The above sequence of operations shown in FIGS. 2 through 4 respectively is repeated until the amount of the powdery mold lubricant in the fixed volume space 15 becomes a fixed amount.

Figure 5:
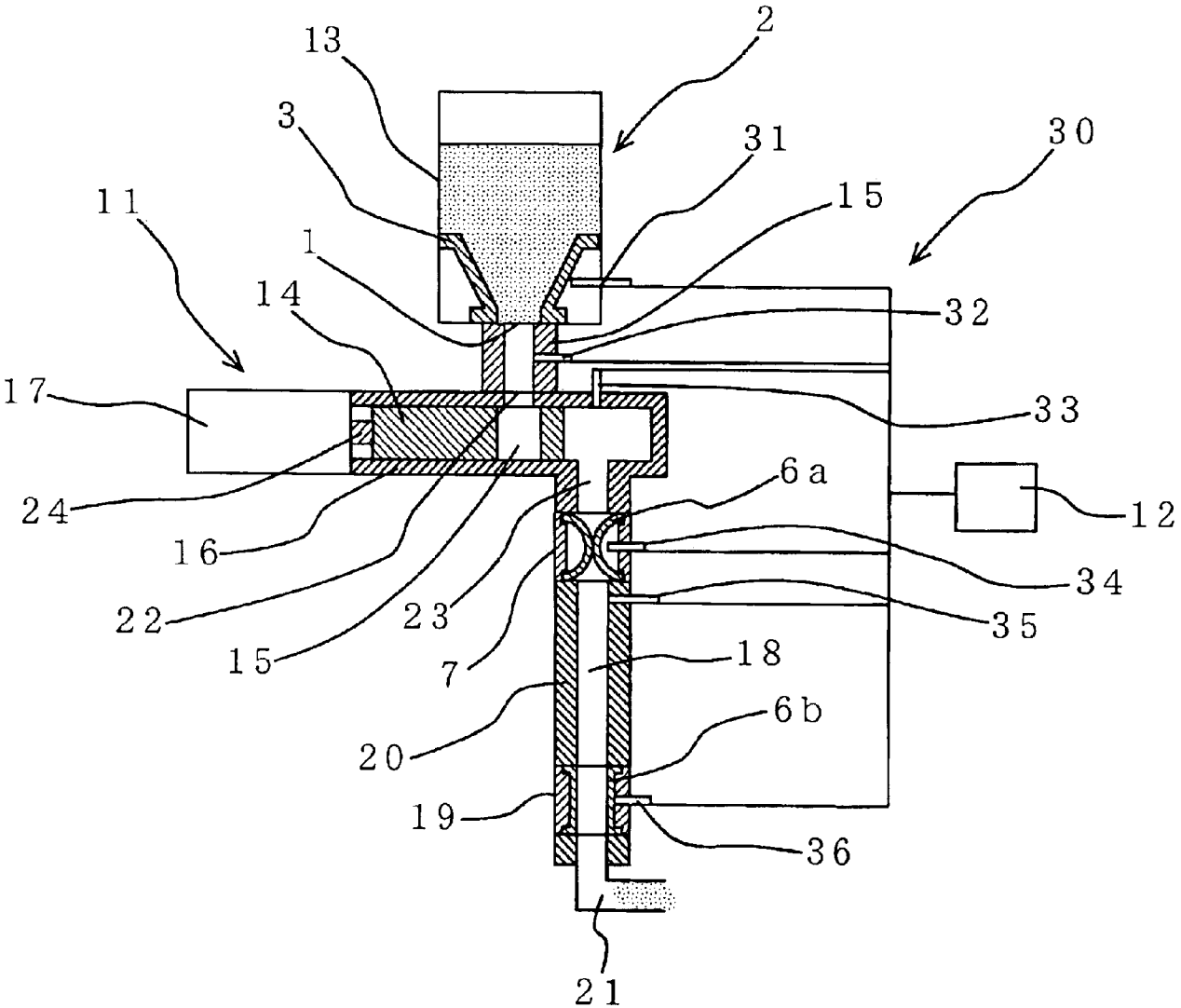
FIG. 5 illustrates how the powdery mold coating agent is fed into a mold.

When the stored amount of the powdery mold lubricant in the space 18 is found to reach the fixed value, as shown in FIG. 5, establishing and interrupting air supplies to the air supply port 34 and the air supply port 36 to close the first pinch valve 7 and to open the second pinch valve 19, respectively. In the resultant state, supplying the pressurized air to the air supply port 35 establishes a supply of the powdery mold lubricant into the cavity (cf. FIGS. 6(*a*)–(*c*)) of the mold which is previously evacuated or reduced in pressure to vacuum.

Figure 6B:
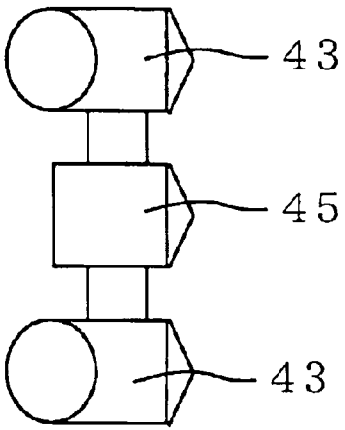
FIGS. 6(*a*), (*b*), and (*c*) are front, plain, and side views, respectively, of the mold which was used in experiments.
Figure 6A:
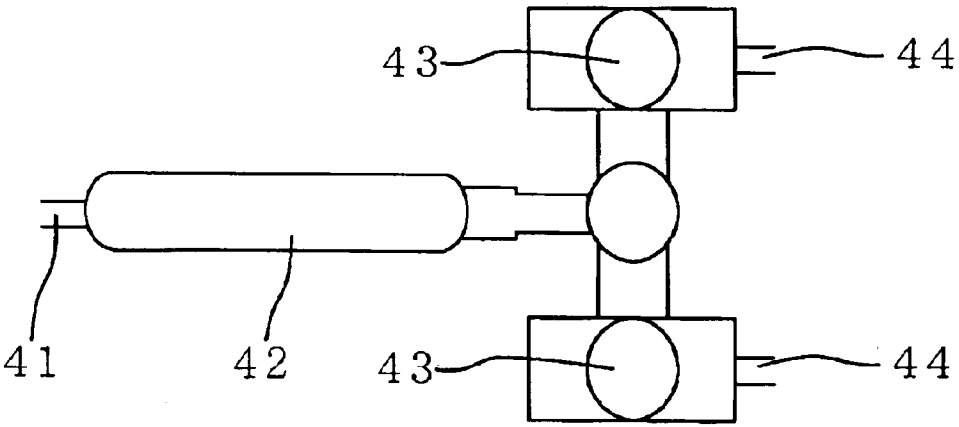
Figure 6C:
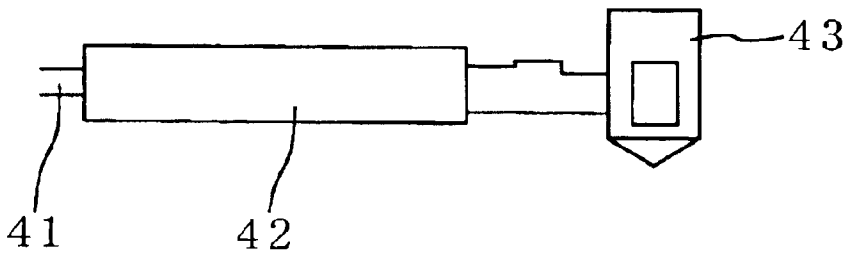

Mold coating experiments were conducted in which the foregoing powdery mold lubricant supply device is used which is in association with the mold whose cavity having an inner structure shown in FIGS. 6(*a*), 6(*b*), and 6(*c*). In detail, the cavity is made up of a runner portion 42 which is in fluid communication with the hose 21 by way of the supply port 41, a gate squeezing portion 45, and a product portion 43. The powdery mold lubricant is fed into the production portion 43 by way of the hose 22, the supply port 41; the runner portion 42, and the squeeze gate portion 45. The product portion 43 is positioned in association with a vacuum device such as a vacuum pump (not shown) by way of a suck port 44.

As the powdery mold lubricant, a substance of graphite family or group which is of an average diameter of 6–8 $\mu$m. The temperature of the cavity is set to be 150° C. The pressure within the cavity is set to be −0.09 Mpa by evacuating the cavity. The pressure of the air for discharging the cavity is set to be 0.3 Mpa. The air is set to be discharged for a time duration of 0.5 seconds. The amount of the powdery mold lubricant is adjusted to 1 g.

After feeding the powdery mold lubricant into the cavity of the mold, an amount of the powdery mold lubricant adhered on the inside surface of the cavity was measured. The measuring procedure is as follows: Aluminum-made tapes having a square shape in which each side is about 1 cm are adhered on plural portion of the inside surface of the cavity. After discharging the powdery mold lubricant into the cavity, the aluminum-made tapes are stripped off or removed from the inside surface of the cavity, an adhesive area rate is measured on which the powdery mold lubricant is adhered. The area on which the powdery mold lubricant is adhered is, after taking a picture thereof, measured or determined by analyzing the picture image. As to the conventional powdery mold lubricant supply device, similar, experiments were conducted made by using the same cavity.

Figure 7:
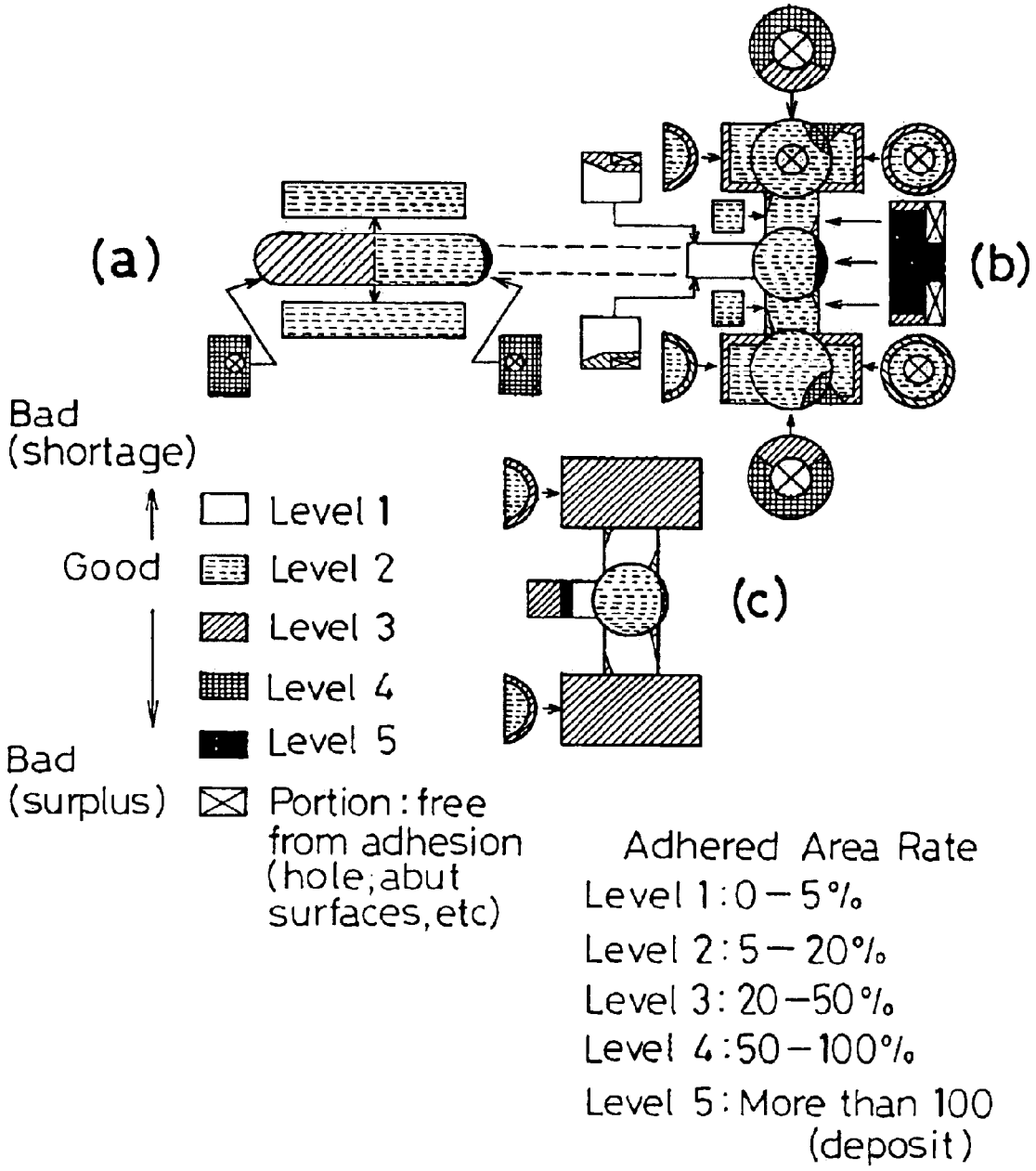
FIGS. 7(*a*), (*b*), and (*c*) show the present invention's mold lubricant adhesive degrees at a runner portion, at both a gate squeeze portion and an upper portion of a product, and at both the gate squeeze portion and a lower portion of the product FIGS. 8(*a*), (*b*), and (*c*) show the present invention's mold lubricant adhesive degrees at a runner portion, at both of a gate squeeze portion and an upper portion of a product, and at both the gate squeeze portion and a lower portion of the product and product upper portion.
Figure 8:
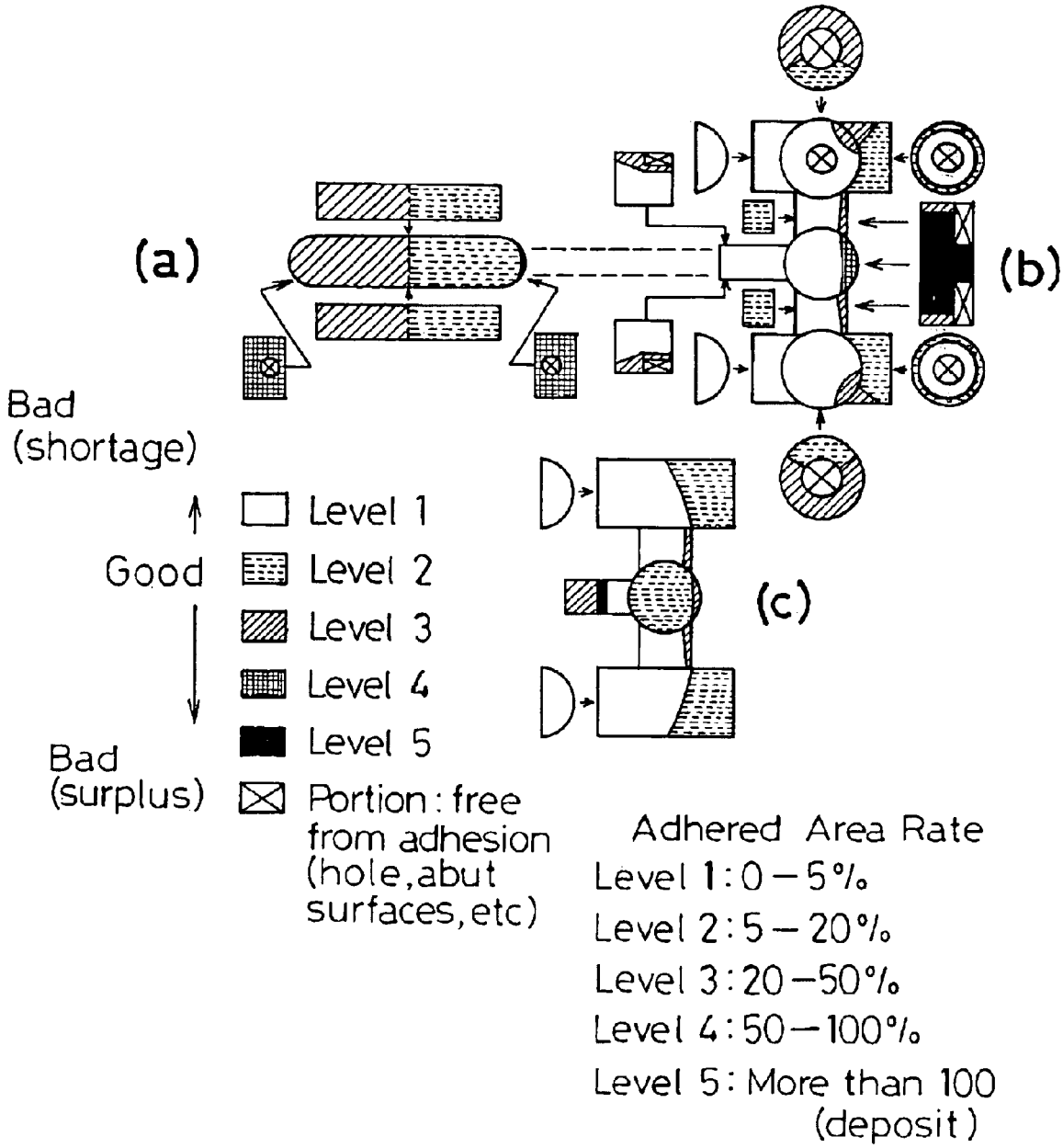
Figure 9A:
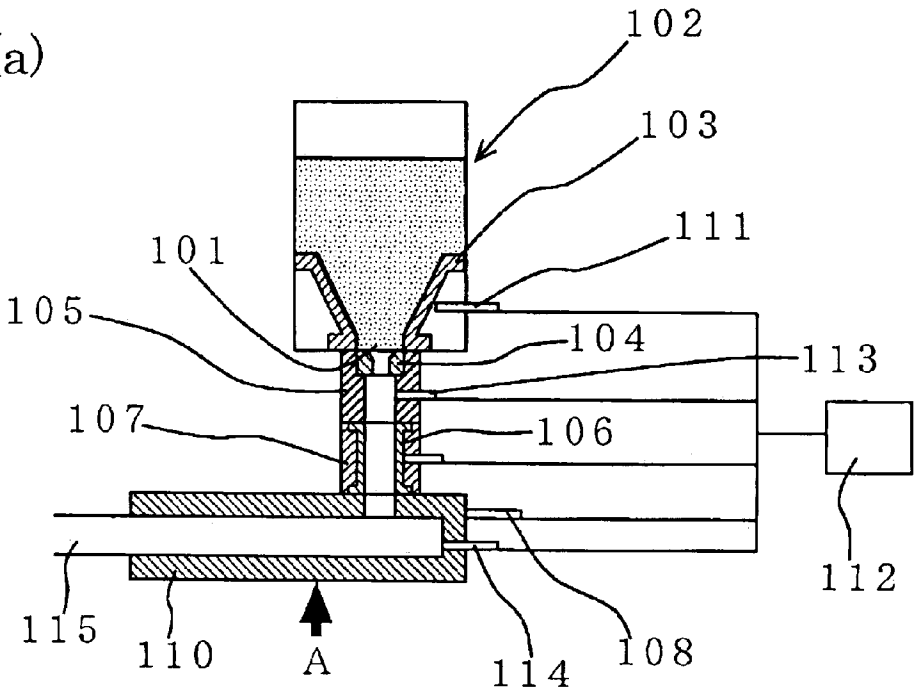
FIG. 9(*a*) illustrate a cross-sectional view of a conventional powdery mold coating agent supply device and FIG. 9(*b*) is a view of the FIG. 9(*a*)-shown device seen from in the direction A in FIG. 9(*a*).
Figure 9B:
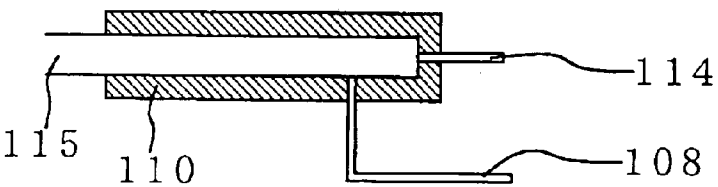

The experimental results of the present embodiment and the conventional device are illustrated in FIG. 7 and FIG. 8, respectively. In each of FIG. 7 and FIG. 8, as to indicated portions indicated by respective arrows, its adhesive status or condition is represented by level indication or distribution:

Level 1:0≦Adhesive rate<5{%)

Level 2:5≦Adhesive rate<20{%)

Level 3:20≦Adhesive rate<50(%)

Level 4:50≦Adhesive rate<100(%)

Level 5:100≦Adhesive rate (%)(i.e. the accumulated state of powdery mold lubricant)

In order to ensure the production of high quality products, it is requested that the adhesive rate in the production port 43 be between Level 2 and level 4. Upon Level 1 being reached, releasing the product becomes difficult, resulting in burn-in and/or clinging problems: In the case of Level 5, a gas is generated in the cavity, resulting in making the product poor in quality.

Analyzing the experimental results in relation to the conventional device reveals that there are many portions or areas which are insufficient in adhesive amount and the adhesion amounts are not uniform. To the contrary, analyzing the experimental results in relation to the present embodiment reveals that all adhesive statuses at the inside surface fall on one of Levels 2, 3, and 4 and the adhesion amounts are substantially uniform. As a result of doing a vertical die casting of aluminum alloy ADC12 which is prepared for die casting, the resultant or produced product is found not to be bad, resulting in that establishment of producing die-cast products of eminent quality.

As described above in greater detail, the first pinch valve 7 can make the powdery mold lubricant measuring portion 40 closed, a set of the first pinch valve 7 and the second pinch valve 19 can make the supply tube 20 become closed, and the second pinch valve 19 can make the mold become closed, resulting in that the valve closure making it possible to keep the mold at vacuum pressure level until ready to discharge the powdery mold lubricant.

In addition, the vertical arrangement of the supply tube into which the powdery mold lubricant is dropped, the powdery mold lubricant is pushed out by applying the pressurized air thereto, and the resultant powdery mold lubricant and the pressurized air are fed, in such an order, into the mold. Thus, the degree of vacuum in the mold is kept as precise as possible and the feeding of the powdery mold lubricant into the mold with priority makes it possible to stabilize the reduced pressure state or vacuum state in the mold. Thus, the powdery mold lubricant can adhere uniformly on any portion on the inside surface of the cavity of the mold, which results in improvement in product quality. In the conventional device, for the uniform adhering of the powdery, the principle of electrostatic coating is employed, thereby requiring an apparatus for charging the powdery mold lubricant. However, the device of the present embodiment is free from charging the powdery mold lubricant and provides an adhesiveness which is not less than that from the conventional device, thereby making it possible to produce the present device at a lower cost.

Interposing the powdery mold lubricant measuring portion 40 between the tank 2 and the supply tube 20 makes it possible to make the supply amount of the powdery mold lubricant much more precise. The powdery mold lubricant measuring portion 40 has the fixed amount space 15 of a slide cut plate type which is capable of reciprocating in sliding mode and which is arranged at right under the discharge port 1 of the tank 2 and at the just above the supply tube 20. This measuring portion 40, which has the aforementioned simple structure, makes it possible to measure the amount of the powdery mold lubricant in very precise fashion and can be produced at a lower cost. Needless to say, the foregoing measuring means is an example and is not restrictive. Thus, other types of measuring means are available. The first open/close means (the second open/close means) is in the form of the pinch valve but is not limited thereto. Any device which acts to open and close is available. The merit of employing the pinch valve is that even if the powdery mold lubricant remains in the valve, the valve becomes free from malfunction and therefore the pinch valve, is rapid acting in opening/closing the powder.

Instead of the pressurized air blowing, other means are available for shifting or moving the powdery mold lubricant. However, the pressurized air make it possible to move the powder in easy way and such a movement requires no other gas, which fails to cost.

As mentioned above, the prevent invention provides a powdery mold coating agent supply device includes:

a tank storing therein an amount of powdery mold coating agent, the tank being provided at its lower portion with a discharge port;

a supply tube connected at its upper end to the discharge port, the supply tube extending along a vertical line;

first open/close valve means provided at an upper position of the supply tube for opening and closing the supply tube; and second open/close valve means provided at a position of the supply tube so as to be lower than the position of the first open/close valve means by a predetermined distance, the second open/close valve means being for opening and closing the supply tube. Thus, the first open/close valve means and the second open/close valve means make it possible to bring each of the tank, the supply tube, and a mold into a closed space state and therefore an inside of the mold can be kept at vacuum state by closing the open/close valve means until ready for an injection of the powdery mold coating agent. In addition, the powdery mold coating agent is dropped into the supply tube to fill the same and thereafter is pushed out by, for example, gas, which establishes a priority feeding of the powdery mold coating agent into the mold which kept at stable vacuum state, resulting in uniform adhesion or application of the powdery mold coating agent onto the inside surface of the mold. Such uniform adhesion or application of the powdery mold coating agent makes it possible to produce die cast products of high quality.

The invention has thus been shown and described with reference to specific embodiments, however, it should be understood that the invention is in no way limited to the details of the illustrated structures, and changes and modifications may be made without departing from the scope of the appended claims.

What is claimed is:

1. A supply device comprising:

a tank configured to store a powdered coating agent therein;

a supply tube configured to extend vertically to guide the powdered coating agent from the tank to a mold;

first and second valves disposed in the supply tube and positionable to permit and to impede a flow of powdered coating agent through the supply tube;

a pressurized fluid inlet configured to deliver a pressurized fluid to the powdered coating agent between the first and second valves;

a measuring device disposed between the tank and the supply tube, the measuring device configured to receive a fixed amount of powdered coating agent from the tank and to deliver the fixed amount of powdered coating agent to the supply tube, the measuring device comprising a piston configured to be horizontally movable within a cylinder, and the piston defining a void configured to receive and to deliver the fixed amount of powdered coating agent; and a second pressurized fluid inlet disposed in the cylinder and configured to deliver pressurized fluid to the powdered coating agent in the void of the piston.

2. The supply device according to claim 1, further comprising:

a fluid pressurizing device configured to deliver the pressurized fluid to the pressurized fluid inlet and the second pressurized fluid inlet.

3. The supply device according to claim 1, wherein at least one of the first and second valves comprises a pinch valve.

4. The supply device according to claim 3, wherein the pinch valve is configured to receive the pressurized fluid from the fluid pressurized device.

5. A supply device comprising:

a tank configured to store a powdered coating agent therein;

a supply tube configured to guide the powdered coating agent from the tank to a mold, the supply tube comprising first and second valves positionable to permit and impede flow of the powdered coating agent to the mold;

a measuring device configured to receive a fixed amount of the powdered coating agent from the tank and to deliver the powdered coating agent to the supply tube, the measuring device comprising a piston defining a void configured to receive and to deliver the powdered coating agent, the piston movably disposed in a cylinder;

a pressurized fluid inlet configured to deliver a pressurized fluid to the powdered coating agent in the measuring device, the pressurized fluid inlet configured to deliver the pressurized fluid to the powdered coating agent in the void of the piston when the void is aligned with the supply tube; and a second pressurized fluid inlet configured to deliver pressurized fluid to the powdered coating agent between the first and second valves.

6. The supply device according to claim 5, further comprising:

a fluid pressurizing device configured to deliver the pressurized fluid to the pressurized fluid inlet and the second pressurized fluid inlet.

7. The supply device according to claim 6, wherein at least one of the first and second valves comprises a check valve.

* * * * *